US006354054B1

(12) United States Patent
Verelli et al.

(10) Patent No.: US 6,354,054 B1
(45) Date of Patent: Mar. 12, 2002

(54) REBAR SUPPORT SYSTEM

(76) Inventors: Angelo Verelli, 4735 Victorin, St-Leonard QC (CA), H1R 3E2; Carlo Verelli, 532, 90$^{e}$Avenue, LaSalle QC (CA), H8R 2Z7

( * ) Notice: Subject to any disclaimer, the term of this patent is extended or adjusted under 35 U.S.C. 154(b) by 0 days.

(21) Appl. No.: 09/186,649

(22) Filed: Nov. 6, 1998

(51) Int. Cl.$^{7}$ ..... E04C 5/16

(52) U.S. Cl. ..... 52/686; 52/677; 52/687; 52/685; 248/87; 248/440

(58) Field of Search ..... 52/677, 685–689; 248/440, 87; 404/136

(56) References Cited

U.S. PATENT DOCUMENTS

| | | | | | |
|---|---|---|---|---|---|
| 3,788,025 | A | * | 1/1974 | Holmes | 52/685 |
| 3,830,032 | A | | 8/1974 | Robb | |
| 4,682,461 | A | * | 7/1987 | Sizemore | 52/689 |
| 4,835,933 | A | * | 6/1989 | Yung | 52/685 |
| 5,107,654 | A | * | 4/1992 | Leonardis | 52/685 |
| 5,301,918 | A | | 4/1994 | Miller | |
| 5,555,693 | A | * | 9/1996 | Sorkin | 52/689 |
| 5,729,949 | A | * | 3/1998 | Hartzheim | 52/677 |
| 5,822,946 | A | * | 10/1998 | Rasmussen | 52/68.1 |
| 6,089,522 | A | * | 7/2000 | Haslem | 52/677 |

* cited by examiner

*Primary Examiner*—Beth A. Stephan

(57) ABSTRACT

This rebar chair has a body with four legs between which there are defined two intersecting passages for simultaneously receiving the intersecting portions of two rebars normal to each other. The rebars are suspended by a fastening wire or supported by an auxiliary chair below said body. The legs forming one of the passages have a uniform spacing and are adapted to closely straddle the rebar extending through the same. The legs of the second passage flare downwardly so that their spacing progressively increases from the body to the free ends from a spacing smaller than to a spacing greater than the uniform spacing between the legs of the first passage. The chair is positively located and stabilized by the intersecting rebars. A saddle is formed on the top of the body for simultaneously supporting a third rebar. The spacing between the faces of the legs forming a first passage is uniform from the body to the free ends of the legs while the spacing between the faces of the legs forming the other right angle passage increases from the body to the free ends of the legs in such a manner that depending on the orientation of the chair with respect to the rebars the same can be positioned at two adjusted distances from the bottom of the concrete form.

12 Claims, 3 Drawing Sheets

REBAR SUPPORT SYSTEM

FIELD OF THE INVENTION

The present invention relates to rebar supports or chairs to support a grid of rebars at an adjusted distance above the bottom of a concrete form prior to concrete pouring.

BACKGROUND OF THE INVENTION

Known rebar chairs are designed to support a rebar at any position along its length. Such rebar chairs can be accidentally tipped over if the rebar is hit and displaced. This is especially true when the rebars have yet to be tied at their intersections to form a rigid grid.

OBJECTS OF THE INVENTION

It is therefore the primary object of the present invention to provide a rebar chair which overcomes the above-mentioned disadvantage.

Another object of the present invention is to provide a rebar chair capable of supporting a grid of rebars at any one of two levels above the bottom of a concrete form.

Another object of the present invention is to provide a rebar chair capable of supporting two grids of rebars in superposed position.

SUMMARY OF THE INVENTION

The chair in accordance with the present invention serves to support above the bottom of a concrete form, the intersecting portions of two rebars normal to each other. This chair comprises a unitary member including a body having a top end, four legs downwardly depending from said body and spaced from one another to form a first and a second rebar receiving passage which intersect and are normal to each other, said legs having, lower free ends to rest on said concrete form bottom, the spacing between the legs on each side of said first passage being substantially uniform from said body to said free ends such that said legs are adapted to, closely straddle one of the rebar extending through said first passage, said legs being also adapted to straddle the other one of the rebars simultaneously extending through said second passage.

Preferably, the chair further includes a concave rebar supporting and locating saddle formed by the top end of said body, for simultaneously receiving at least one additional rebar thereon, said saddle being parallel to said second passage.

Preferably, the legs on each side of said second passage flare downwardly so that their spacing progressively increases from said body to said free ends from a spacing smaller to a spacing greater than the uniform spacing between the legs on each side of said first passage.

Preferably, each leg forms a first and a second inner, flat side face normal to each other, respectively defining said first and second passages.

Preferably, the lower part of said body forms a first and a second pair of crotches between said legs, said first pair of crotches having a semi-cylindrical surface merging with said first side faces and forming the top of said first passage, said second pair of crotches having an inverted V-shape surface merging with said second side faces and forming the top of said second passage.

The invention is also directed to the combination of the above defined chair with two intersecting rebars respectively extending through said first and second passages and a device for maintaining said intersecting portions above the bottom of a concrete form and below said body. This combination may include a third rebar supported by the saddle. This device is either a fastening wire suspending said intersecting portions from said chair or an auxiliary chair underlying and supporting said intersecting portions and located between said four legs, said auxiliary chair resting on the bottom of said concrete form.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
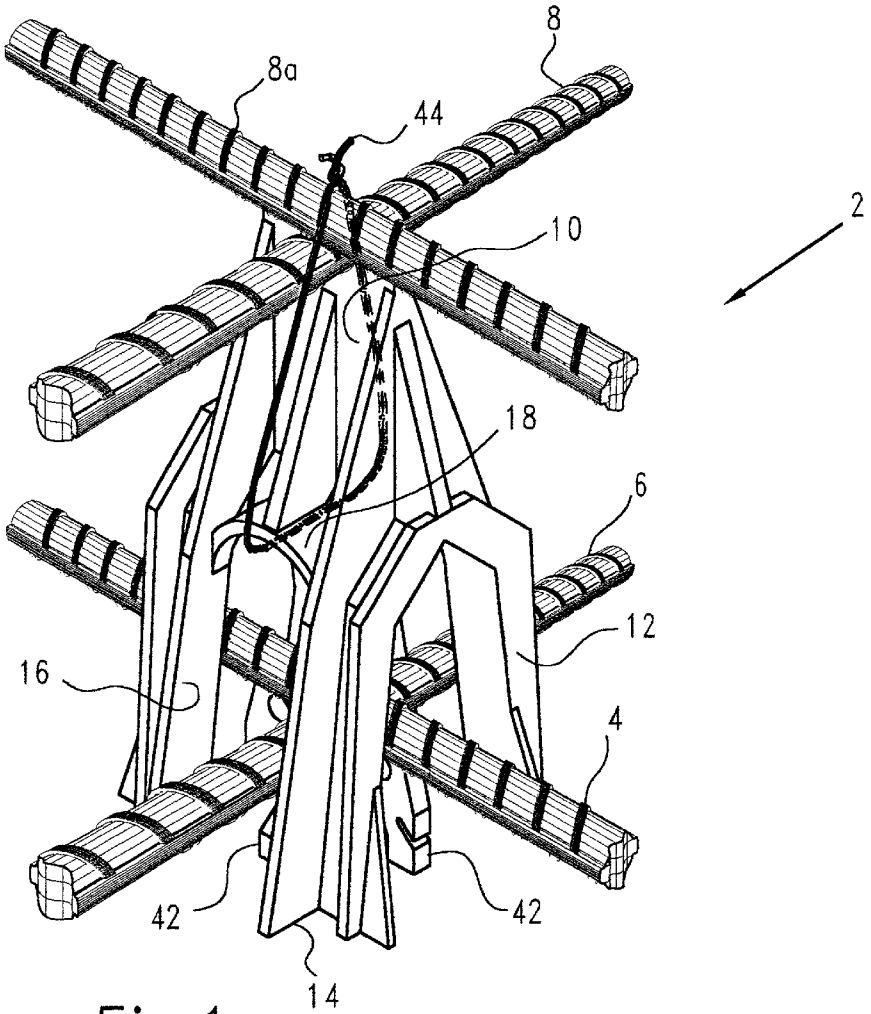
FIG. 1 is a perspective view of the chair, rebars and auxiliary chair.

The chair of the invention is a unitary member preferably moulded out of thermoplastic material and is indicated at 2 in FIG. 1. It serves to support a lower grid of intersecting rebars, namely a top rebar 4 and a bottom rebar 6 at right angles to each other at the intersecting portions of said rebars. It also serves to support a top rebars 8 and 8*a* of a superposed grid. The rebars 4, 6, 8 and 8*a* are supported at an adjusted level above the bottom B of a concrete form prior to pouring concrete therein. The chair 2 includes a body 10 and four legs 12 arranged at the four corners of a square, and symmetrical with respect to the vertical axis of body 10. The lower free ends 14 of the legs 12 are adapted to rest directly on the bottom B of the concrete form; each leg has an L-shape cross-section and defines inner side faces 16 and 22; opposite side faces 16 are joined at the top by a crotch 18 at the lower end of the upright body 10. The crotch 18 forms a semi-cylindrical surface as clearly shown in FIG. 2.

The four inner side faces 16 and the two crotches 18 form a first passage for the top rebar 4. The inner faces 16 are co-planar on each side of the top rebar 4. The first passage has a uniform width, i.e. the spacing between opposite faces 16 is uniform from the crotch 18 to the lower free end 14 of the legs 12. This spacing is selected to be substantially equal to the diameter of the rebars 4 and 6. Therefore, the chair 2 is prevented from lateral movement transverse to the rebar 4 or 6 which extends through the first passage.

Figure 3:
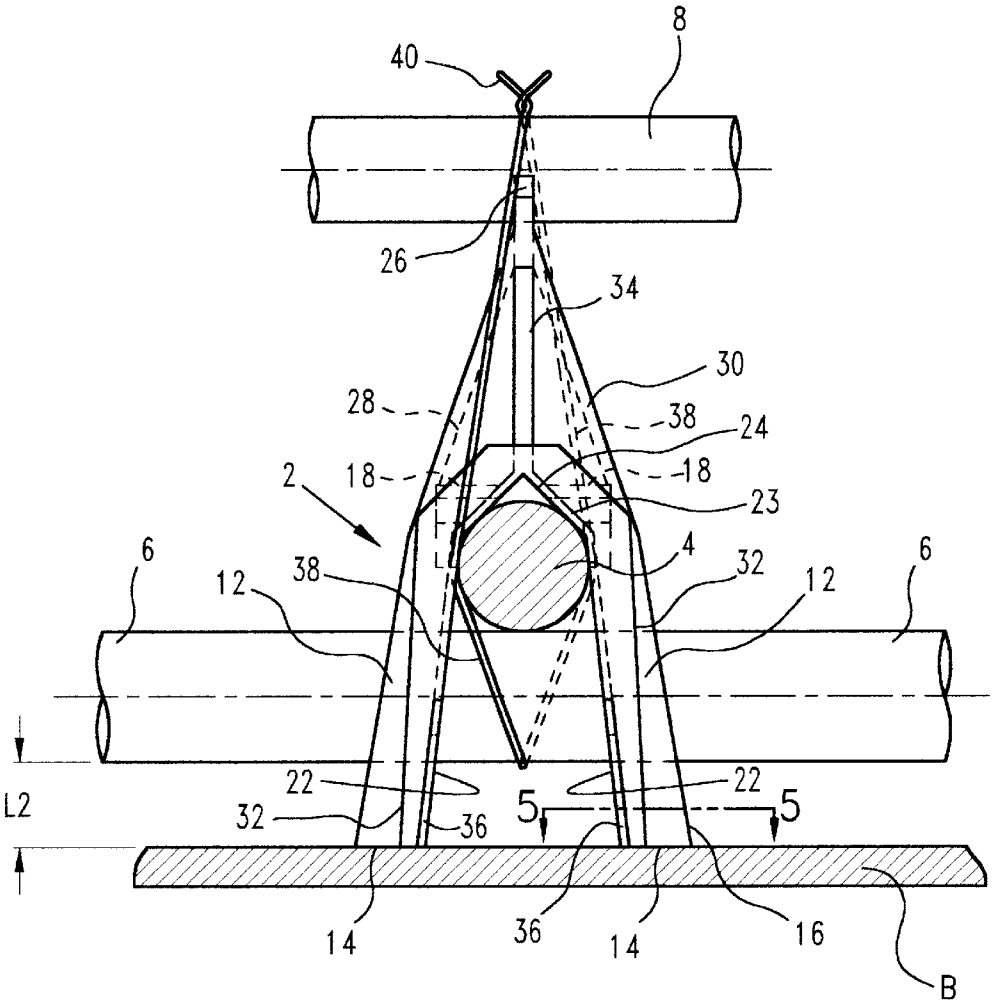

A second passage is defined by the inner side faces 22 of the four legs 12, these side faces being co-planar on each side of the rebar extending there through; the second passage is further defined by a crotch 24 at the bottom of body 10, this crotch 24 having an inverted V-shape as shown in FIG. 3.

The inside faces 22 flare downwardly from the crotch 24 to the lower free ends 14 of the legs 12 as clearly shown in FIG. 3. The spacing of the legs 12 at the bottom of the second passage is greater than the uniform leg spacing of the first passage but the spacing of the legs 12 at the top of the second passage namely is at the junction indicated at 23 in FIG. 3 between the inside faces 22 and the inverted V-shape crotch 24, is smaller than the uniform leg spacing of the first passage.

The top of body 10 forms a concave shape saddle 26 for receiving rebar 8 and supporting the same. Saddle 26 is parallel to the second passage.

The chair 2 is reinforced by a center rib 28 on each side of the body merging with the crotch 18 at its lower end. The chair is further reinforced by two ribs 30 equally spaced on each side of center rib 28 and merging with the inner faces 16 of the four legs 12. These ribs have a generally triangular shape and merge with body 10 just below the saddle 26. The chair is further reinforced by two ribs 32 which extend along the faces 22 and the crotch 24 of the second passage.

The chair is further reinforced by a pair of lateral ribs 34 merging with the respective crotches 24.

Finally, a triangular bottom rib 36 co-planar with each face 22 of the second passage serves to further stabilize the chair against tipping.

Figure 6:
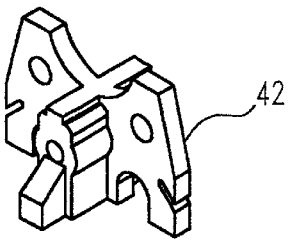
FIG. 6 is a perspective view of the auxiliary chair.

The intersecting portions of the rebars 4 and 6 are suspended between the four legs 12 by means of a fastener wire 38 passing underneath the bottom rebar 6 and either over rebar 8 or directly over saddle 26 if there is no rebar 8. The ends of wire 38 are twisted together as shown at 40. Instead of wire 38 an auxiliary chair 42, shown in FIGS. 1 and 6 is located between the four legs 12 under the intersecting portions of rebars 4 and 6 to support the same above floor B, chair 42 is conventional.

In the case two rebars 8, 8*a* are superposed above the saddle 26 as shown in FIG.1, a wire 44, similar to the fastener wire 38, may be used to fasten them to the chair 2.

The chair may be positioned at two right angular positions with respect to the intersecting portions of the two rebars 4 and 6.

Figure 2:
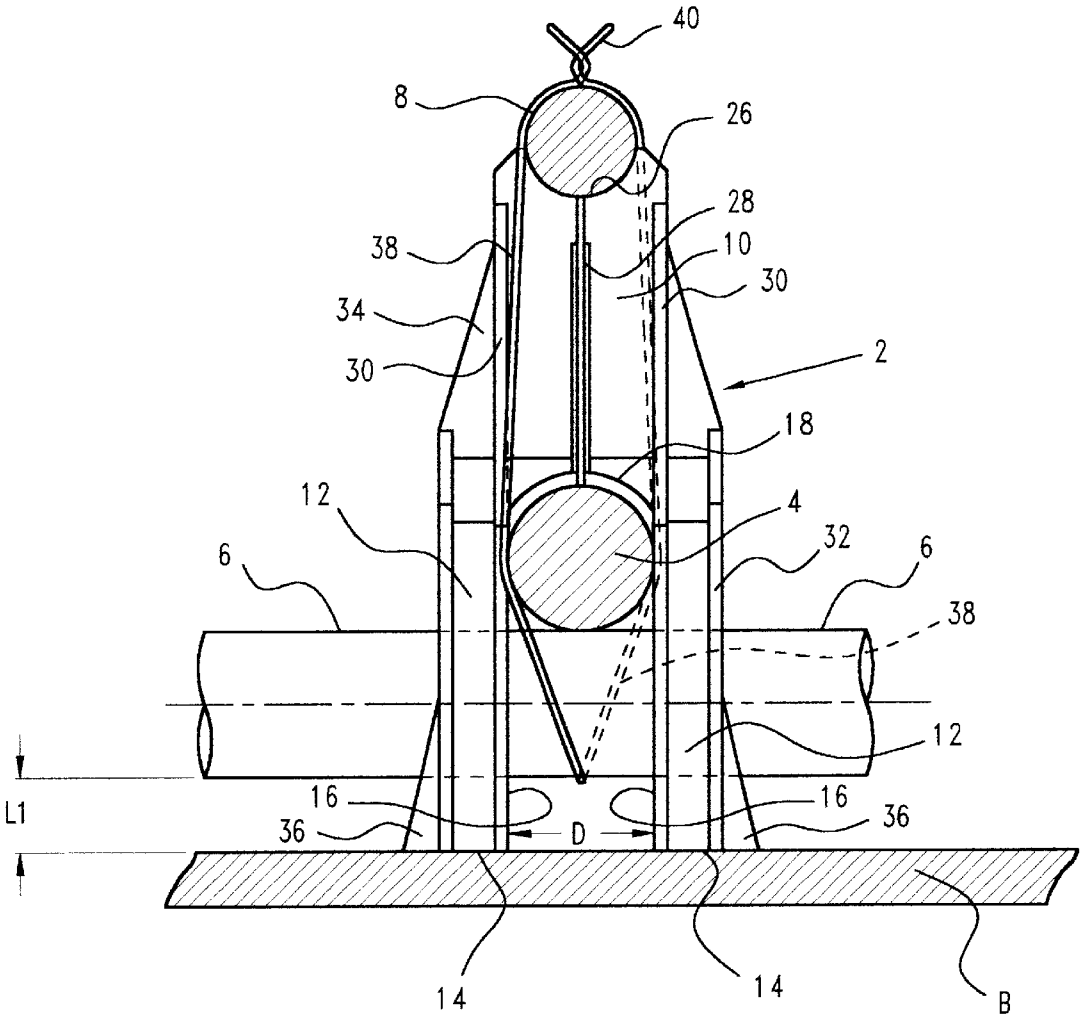
FIGS. 2 and 3 are side elevations of the rebar chair of the invention at right angles to each other; also showing a fastening wire and rebars supported by the chair.
Figure 4:
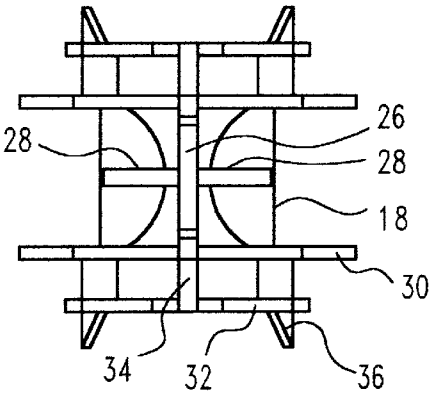
FIG. 4 is a top plan view of FIG. 3.
Figure 5:
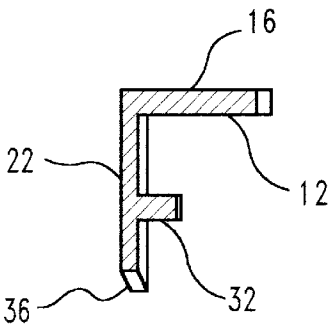
FIG. 5 is a cross-section along line 5—5 of FIG. 3.

As shown in FIG. 2, when the chair is positioned so that the top rebar 4 extends through the first passage 16 with the top rebar held against the semi-cylindrical crotch 18, the two rebars are held at a minimum distance from the concrete form floor B as indicated by L1 in FIG. 2.

When the chair is turned at right angle so that the top rebar 4 extends through the second passage indicated by 22 in FIG. 3, then the distance L2 between the bottom B and the bottom rebar 6 is smaller than L1. This is so because the top portion of the inner faces 22 of the second passage has a spacing which is less than the spacing between the inner faces 16 of the first passage. Thus an adjustment of about ⅛" is obtained for the height of the rebars above the concrete form floor B using the same chair 2.

The chair is stabilized against tipping because it straddles the intersecting portions of the two rebars 4 and 6.

The chair 2 is moulded in one piece with a minimum of thermo-plastic material and yet is very strong due to the plurality of ribs 32, 34 inclusive.

We claim:

1. The combination comprising a rebar chair, two rebars normal to each other and a device for maintaining intersecting portions of said rebars above a bottom of a concrete form on which the chair rests, said chair comprising a unitary member including a body having a top end, four legs downwardly depending from said body and spaced from one another to form a first and a second rebar receiving passage which intersect and are normal to each other, said legs having lower free ends resting on the bottom of said concrete form, said rebars simultaneously respectively extending through said first and second passage with said body above said intersecting portions, the spacing between the legs on each side of said first passage being substantially uniform with said leas closely engaging one of the rebars extending through said first passage, said device is a fastening wire suspending said intersecting portions from said chair.

2. The combination as defined in claim 1 wherein said device is an auxiliary chair underlying and supporting said intersecting portions and located between said four legs said auxiliary chair resting on the bottom of said concrete form.

3. A rebar chair for supporting above a bottom of a concrete form intersecting portions of two rebars normal to each other, comprising a unitary member including a body having a top end, four legs downwardly depending from said body and spaced from one another to form a first and a second rebar receiving passage which intersect and are normal to each other, said legs having lower free ends to rest on said concrete form bottom, the spacing between the legs on each side of said first passage being substantially uniform from said body to said free ends such that said legs are adapted to closely straddle one of the rebars extending through said first passage, said legs being also adapted to straddle the other one of the rebars simultaneously extending through said second passage, said rebar chair further including a rebar supporting and locating saddle formed by the top end of said body for simultaneously receiving at least one additional rebar thereon, said legs on each side of said second passage flare downwardly so that their spacing progressively increases from said body to said free ends from a spacing smaller to a spacing greater than the uniform spacing between the legs on each side of said first passage.

4. A rebar chair as defined in claim 3, further including a rebar supporting and locating saddle formed by the top end of said body for simultaneously receiving at least one additional rebar thereon.

5. A rebar chair as defined in claim 3, wherein each leg forms a first and a second inner, flat side face normal to each other, respectively defining said first and second passages.

6. A rebar chair as defined in claim 5, wherein the lower part of said body forms a first and a second pair of crotches between said legs, said first pair of crotches having a semi-cylindrical surface merging with said first side faces and forming the top of said first passage, said second pair of crotches having an inverted V-shape surface merging with said second side faces and forming the top of said second passage.

7. A rebar chair as defined in claim 6, further including a rebar supporting and locating saddle formed by the top end of said body for simultaneously receiving at least one additional rebar thereon, said saddle being parallel to said second passage.

8. A rebar chair as defined in claim 7, wherein said saddle is concave.

9. The combination comprising a rebar chair, two rebars normal to each other and a device for maintaining intersecting portions of said rebars above a bottom of a concrete form on which the chair rests, said chair comprising a unitary member including a body having a top end, four legs downwardly depending from said body and spaced from one another to form a first and a second rebar receiving passage which intersect and are normal to each other, said legs having lower free ends resting on the bottom of said concrete form, said rebars simultaneously respectively extending through said first and second passage with said body above said intersecting portions, the spacing between the legs on each side of said first passage being substantially uniform with said legs closely engaging one of the rebars extending through said first passage, said rebar chair further including a rebar supporting and locating saddle formed by the top end of said body and a third rebar simultaneously supported on said saddle above said intersecting rebars, said legs on each side of said second passage flare downwardly so that their spacing progressively increases from said body to said free legs from a spacing smaller than to a spacing greater than the uniform spacing between the legs on each side of said first passage.

10. The combination as defined in claim 9, wherein each leg forms a first and a second inner flat side face normal to each other and respectively defining said first and second passages.

11. The combination as defined in claim 10, wherein a lower part of said body forms a first and a second pair of crotches between the legs, said first pair of crotches having a semi-cylindrical surface merging With said first side faces and forming a top of said first passage against which one of said intersecting rebars abut, said second pair of crotches having an inverted V-shape surface merging with said second side faces and forming a top of said second passage.

12. The combination as defined in claim 11, wherein said saddle is parallel to said second passage and is concave.

* * * * *